US005938511A

United States Patent [19]

Patterson

[11] Patent Number: 5,938,511

[45] Date of Patent: Aug. 17, 1999

[54] GRINDING GUIDE ASSEMBLY

[76] Inventor: James D. Patterson, 891 Fairfield, Temperance, Mich. 48182

[21] Appl. No.: 08/976,336

[22] Filed: Nov. 21, 1997

[51] Int. Cl.[6] ..... B24B 19/00

[52] U.S. Cl. ..... 451/377; 451/365; 451/392; 451/367

[58] Field of Search ..... 451/377, 364, 451/365, 367, 392, 391, 426, 460

[56] References Cited

U.S. PATENT DOCUMENTS

| | | | |
|---|---|---|---|
| D. 367,018 | 2/1996 | Bernat . | |
| 2,565,309 | 8/1951 | Jacoby, Jr. | 51/92 |
| 3,054,229 | 9/1962 | Peasley et al. | 51/122 |
| 3,355,841 | 12/1967 | Niquet | 51/94 |
| 3,879,899 | 4/1975 | Ribar | 51/92 BS |
| 3,881,888 | 5/1975 | Schwab | 51/218 R |
| 3,883,995 | 5/1975 | Ohashi | 51/91 BS |
| 4,155,383 | 5/1979 | Welliver . | |
| 4,259,814 | 4/1981 | Glaser et al. | 51/122 |
| 4,483,104 | 11/1984 | Welliver . | |
| 4,936,053 | 6/1990 | Shanelec | 51/92 BS |
| 4,961,288 | 10/1990 | Ketteringham | 51/92 BS |
| 5,218,787 | 6/1993 | Rice | 51/91 BS |
| 5,234,266 | 8/1993 | Musselman et al. . | |
| 5,573,316 | 11/1996 | Wankowski . | |

*Primary Examiner*—David A. Scherbel
*Assistant Examiner*—Dung Van Nguyen
*Attorney, Agent, or Firm*—MacMillan, Sobanski & Todd, LLP

[57] ABSTRACT

A grinding guide assembly for grinding or sharpening the carbide surface of a snowmobile wear bar. The grinding guide assembly features a pair of angle adjusters and a support guide that slide together back and forth across a pair of substantially parallel rods. The angle at which the wear bar contacts the grinding surface may be selected while the wear bar is securely clamped to the support guide. The length of the rods may be any desired length to allow the grinding guide assembly the capability to grind or sharpen an object of any length.

14 Claims, 1 Drawing Sheet

GRINDING GUIDE ASSEMBLY

BACKGROUND OF THE INVENTION

1. Field of the Invention

The invention relates in general to a grinding accessory and, in particular, to a grinding guide for sharpening a carbide surface on a snowmobile wear bar.

2. Related Art

Sharpening and grinding accessories are well known generally in the art. For example, U.S. Pat. No. 4,155,383 to Welliver shows a router accessory that facilitates edging, trimming and groove cutting using a two-tiered construction. The workpiece is positioned on the work table pivotally mounted to the lower tier, while the router is vertically mounted on the upper tier. The upper tier is vertically movable with respect to the lower tier. U.S. Pat. No. 4,483,104 also to Welliver shows a drill bit sharpener comprising a chuck that rides in guide grooves for accurately centering the drill bit. The chuck also has a cam surface for producing reciprocating motion to the drill bit.

None of the prior art shows a tool or accessory that is capable of grinding or sharpening an elongated object and, in particular, a carbide surface on a snowmobile wear bar. A sharp carbide surface allows more turning control, a higher degree of safety and more traction than a duller surface.

In the past, it has been the costly practice to dispose of the snowmobile wear bar once the carbide surface became dull. Thus, it would be desirable to provide an accessory that has the capability to grind and sharpen the carbide surface on the snowmobile wear bar.

SUMMARY OF THE INVENTION

It is an object of the invention to provide a grinding guide assembly for grinding or sharpening an entire length of an object.

It is an another object of the invention to provide a grinding guide assembly that is capable of selecting a desired angle for grinding or sharpening the entire length of an object.

It is yet another object of the invention to provide a grinding guide assembly for grinding or sharpening a carbide surface on a snowmobile wear bar.

To accomplish these and other objects, a grinding guide assembly comprises a base for mounting the grinding guide assembly to a structure. The base including a pair of legs and an elongated support member. Each end of the support member includes a plurality of spaced apart openings. A pair of continuous, substantially parallel rods extend between the ends of the support member. Each rod has a portion that extends outwardly from the support member. An endcap fastens to the portion of rod extending outwardly from the support member to securely hold the rod in place. A pair of angle selectors are slidingly connected to at least one rod by passing the rod through the opening on the lower portion of each angle selector. A support guide is slidingly connected to one of the rods by passing the rod through an opening on a middle portion of the support guide. The support guide is also hingedly connected to each angle selector by passing a fastener through an opening of an outwardly extending rear portion of the support guide and through a slot on the angle selector. A top clamp may be used to clamp studs of a snowmobile wear bar, for example, to the support guide. The top clamp having a pair of holes located at a predetermined location. A pair of springs are interposed between the top clamp and the support member. One spring is aligned with one of the holes of the support guide and with the one of the holes of the top clamp. The other spring is aligned with the other hole of the support guide and the other hole of the top clamp. A pair of fasteners may be used to tighten the top clamp to the support guide to securely hold the wear bar in place. The grinding guide assembly is capable of selecting an angle at which the wear bar contacts a grinding surface while grinding an entire length a carbide surface of the wear bar.

These and other aspects and advantages of the invention are described or apparent from the following detailed description of the preferred embodiments and appended drawings wherein like reference numbers refer to the same element, feature or component.

BRIEF DESCRIPTION OF THE DRAWINGS

The preferred embodiments are described with reference to the wings in which.

DETAILED DESCRIPTION OF THE PREFERRED EMBODIMENTS

Figure 1:
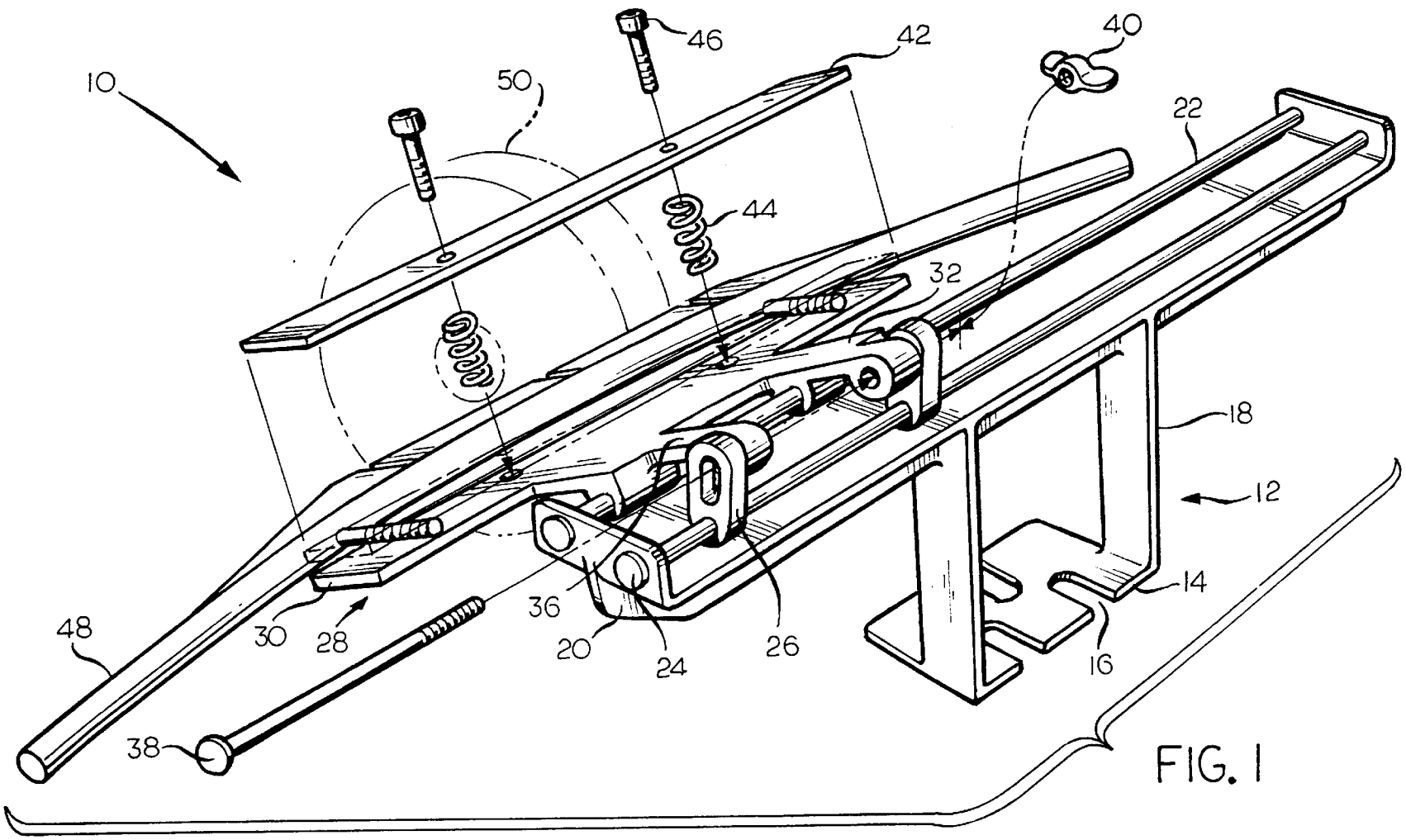
FIG. 1 shows a grinding guide assembly according to a preferred embodiment of the invention.

FIG. 1 shows a grinding guide assembly 10 according to a preferred embodiment of the invention. In general, the grinding guide assembly 10 includes a base 12 including a substantially flat portion 14 having a plurality of slots 16 for mounting the grinding guide assembly 10 to a structure (not shown). The base 12 may be made of any hardened suitable material, such as, stainless steel and the like.

The base 12 also includes a pair of legs 18 extending in a vertical direction from the flat portion 14 of the base 12. An elongated support member 20 is connected to the legs 18 and extends in a longitudinal direction, perpendicular to the vertical direction of the legs 18. It should be appreciated that the invention is not limited by the length of the support member 20 in the longitudinal direction and that the invention can be practiced with the support member 20 having any desired length in the longitudinal direction in order for the grinding guide assembly 10 to be capable of grinding an object having any length. For example, the support member 20 may only be a few inches in length in the longitudinal direction in order to accommodate a comparably-sized object. On the other hand, the support member 20 may be several feet in length in order to accommodate an elongated object several feet in length.

In the preferred embodiment, the support member 20 includes a pair of openings on each end of the support member 20 for receiving a rod 22 that extends between the ends of the support member 20. Preferably, each rod 22 has an outer diameter slightly less than the diameter of the opening of the support member 20 so that each rod 22 is capable of passing through the opening of the support member 20. In addition, the length of each rod 22 is slightly longer than the length of the support member 20 so that each rod 22 extends outwardly from the end of the support member 20. The locations of the openings on each end of the support member 20 are such that each rod 22 is substantially parallel to each other once received in the openings. Preferably, each rod 22 is securely fastened to the support member 20 by an endcap 24 fitted over the outwardly extending portion at each end of the rod 22. It should be appreciated that outwardly extending portion of the rod 22 may be securely fastened using any suitable conventional fastening means, such as, welding, glueing and the like.

Preferably, the grinding guide assembly 10 includes a pair of angle selectors 26 for selecting an angle at which the object 48, for example, a wear bar for a snowmobile, contacts a grinding surface 50. As seen in FIG. 1, each angle selector 26 has an upper portion with a slot and a lower portion with an opening. As discussed below, the slot in the angle selector 26 has a length in the vertical direction to enable the grinding guide assembly 10 to select an angle at which the object 48 contacts the grinding surface 50. It should be appreciated that the greater the length, the greater the amount at which the angle selector 26 may select the angle at which the object 48 contacts the grinding surface 50. The diameter of the opening of each angle selector 26 is slightly larger than the outer diameter of each rod 22 so that each angle selector 26 may be slidingly connected to the rod 22 by passing the rod 22 through the opening. To facilitate each angle selector 26 sliding back and forth on the rod 22, the inside surface of the opening may include means well-known in the art, such as, roller bearings, silicon and the like.

The grinding guide assembly also includes a support guide 28 for supporting the object 48 to be sharpened or ground by the grinding surface 50. The support guide 28 includes a substantially flat front portion 30 having a pair of holes, a middle portion 32 with a downwardly extending portion having an opening, and an outwardly extending rear portion 34 having an opening. The middle portion 32 of the support guide 28 is slidingly connected to one of the rods 22 by passing a different one of the rods 22 through the opening in the middle portion 32 of the support guide 28. Similar to the angle selector 26, the inside surface of the opening may include means well-known in the art, such as, roller bearings, silicon and the like, in order to facilitate the support guide 28 sliding back and forth on the rod 22. Similar to the support member 20, the length of the support guide 28 may also be made to any length to sufficiently support the object 48.

The support guide 28 may be hingedly connected to the angle selector 26 by passing a conventional fastener 38, such as a bolt and the like, through the opening in the outwardly extending rear portion 36 of the support guide 28 and through the slot on the angle selector 26. A wingnut 40 may be used to tighten the fastener 38 such that the angle adjusters 26 and support guide 28 are urged toward each other and frictionally engage each other so that they move together as they are slid across the rods 22.

It should be realized that raising the rear portion 36 of the support guide 28 causes the front portion 30 of the support guide to lower, and vice versa. Thus, the angle at which the object 48 contacts the grinding surface 50 may be selected by loosening the wing nut 40 and raising or lowering the rear portion 36 of the support guide 28 until the desired angle that the object 48 contacts the grinding surface 50 is selected.

The grinding guide assembly 10 further includes a top clamp 42 for clamping the object securely to the support guide 28. As seen in FIG. 1, the top clamp 42 includes a pair of holes that are located at predetermined locations.

A pair of springs 44 are interposed between the top clamp 42 and the front portion 30 of the support member 28. Preferably, a pair of threaded fasteners 46 may be inserted through the holes in the top clamp 42. The fasteners 46 may be conventional fasteners, such as bolts, screws and the like. To assemble the top clamp 42 to the front portion 30 of the support guide 28, each spring 44 are aligned with the holes in the support guide 28 and also with the holes in the top clamp 42. Then, the fasteners 46 are inserted through the holes in the top clamp 42 and may be screwed into the front portion 30 of the support guide 28 to securely hold the object 48 in place. Alternatively, the fasteners 46 may be bolted to the front portion 30 of the support guide 28.

The grinding guide assembly 10 may be used in a variety of different applications in which the object 48 is held firmly in place at the desired angle with respect to the grinding surface 50. For example, FIG. 1 shows the grinding guide assembly 10 being used to hold a carbide wear bar 48 of a snowmobile (not shown) firmly in place at a desired angle with respect to a grinding wheel 50. In this manner, the grinding guide assembly 10 may be used to sharpen the carbide runner of the wear bar 48 at the desired angle by moving the angle adjusters 26 and the support guide 28 along the rods 22 in a back and forth or reciprocating motion in the longitudinal direction.

It is envisioned that the rods 22 of the preferred embodiment may be replaced with a single rod or member having a slotted surface. The support guide 28 may then be formed in a complementary shape to attach to the slotted member to form a interconnected assembly. The assembly may be tilted in the vertical direction to select the angle at which the object contacts the grinding surface.

While this invention has been described in conjunction with specific embodiments, it is evident that many alternatives, modifications and variations will be apparent to those skilled in the art. Accordingly, the preferred embodiments of the invention as set forth herein are intended to be illustrative, rather than limiting. Various changes may be made without departing from the spirit and scope of the invention as defined in the following claims.

What is claimed is:

1. A grinding guide assembly for use in sharpening a wear bar of a snowmobile, comprising:

a base for mounting said grinding guide assembly to a structure, said base including a pair of legs and an elongated support member having ends, each end including a plurality of spaced apart openings;

a pair of continuous, substantially parallel rods extending between the ends of said support member, each rod having a portion passing through one of the openings and extending outwardly therefrom;

means for fastening the portion of said pair of rods extending outwardly from said support member;

a pair of angle selectors, each angle selector having an upper portion with a slot and a lower portion with an opening, each angle selector being slidingly connected to said pair of rods by passing one of said pair of rods through the opening on the lower portion of each angle selector;

a support guide including a substantially flat front portion having a pair of holes, a middle portion with a downwardly extending portion having an opening, and an outwardly extending rear portion having an opening, said support guide being slidingly connected to one of said plurality of rods by passing a different one of said pair of rods through the opening of the middle portion of said support guide, said support guide being hingedly connected to said angle selector by passing a fastener through the opening of the outwardly extending rear portion of said support guide and through the slot on said angle selector;

a top clamp for clamping studs of a snowmobile wear bar to said support guide, said top clamp having a pair of holes located at a predetermined location;

a pair of springs interposed between said top clamp and said support member, one spring being aligned with one of the pair of holes of said support guide and one of the pair of holes of said top clamp, and the other spring being aligned with the other hole of the pair of holes of said support guide and the other hole of the pair of holes of said top clamp; and a pair of fasteners for fastening said top clamp to said support guide;

wherein the grinding guide assembly is capable of selecting an angle at which the wear bar contacts a grinding surface.

2. An apparatus for grinding an elongated object, comprising:

a base including a support member having a plurality of openings on both ends thereof;

a plurality of substantially parallel rods extending between the ends and outwardly through the openings of the support member;

an angle selector slidingly connected to one of said plurality of rods, said angle selector including an upper portion with a slot and a lower portion with an opening;

a support guide slidingly connected to one of said plurality of rods and hingedly connected to said angle selector; and clamping means for clamping the object to said support guide, wherein said support guide and said angle selector are capable of traversing an entire distance between both ends of said support member in order to grind the elongated object.

3. The apparatus according to claim 2, further comprising means for fastening said plurality of rods to the ends of said support member.

4. The apparatus according to claim 2, wherein said clamping means comprises a top clamp member, a plurality of springs disposed between said top clamp and said support guide, and means for fastening said top clamp to said support guide.

5. The apparatus according to claim 2, wherein said angle selector is slidingly connected to one of said plurality of rods by passing one of said plurality of rods through the opening on the lower portion of said angle selector.

6. The apparatus according to claim 2, wherein said support guide includes a substantially flat front portion, a middle portion with a downwardly extending portion having an opening, and an outwardly extending rear portion having an opening.

7. The apparatus according to claim 6, wherein said support guide is hingedly connected to said angle selector by passing a fastener through the opening of the outwardly extending rear portion of said support guide and through the slot on said angle selector.

8. The apparatus according to claim 6, wherein said support guide is slidingly connected to one of said plurality of rods by passing one of said plurality of rods through the opening of the middle portion of said support guide.

9. An apparatus for sharpening an object, comprising:

means for mounting the apparatus to a structure, said mounting means comprising a base and an elongated support member, said base including a plurality of slots for mounting the apparatus to the structure, said support member including a plurality of openings at each end thereof;

means for sliding the apparatus in a longitudinal direction;

means for attaching the object to the apparatus;

means for selecting an angle at which the object contacts a grinding surface.

10. The apparatus according to claim 9, wherein said sliding means comprises at least one rod connected to said mounting means, at least one angle selector slidingly connected to said at least one rod, and a support guide slidingly connected to said at least one rod and hingedly connected to said at least one angle selector.

11. The apparatus according to claim 10, wherein said at least one rod passes through openings in said at least one angle selector and said support guide to slidingly connect said at least one rod and said at least one angle selector.

12. The apparatus according to claim 9, wherein said attaching means comprises a top clamp, a support guide and a fastener for fastening said top clamp to said support guide together to securely clamp the object to the apparatus.

13. The apparatus according to claim 9, wherein said angle selecting means comprises at least one angle selector and a support guide hingedly connected to said at least one angle selector.

14. The apparatus according to claim 13, wherein said support guide and at least one angle selector are hingedly connected by passing at least one rod through an opening in said support guide and passing a fastener through a slot in said at least one angle selector and through a different opening in said support guide.

* * * * *